US006220541B1

(12) United States Patent
Caprario

(10) Patent No.: US 6,220,541 B1
(45) Date of Patent: Apr. 24, 2001

(54) WEB WINDING APPARATUS WITH TWO MANDRELS MOUNTED AT FIXED POSITIONS AND KNIFE CARRIAGE MOVABLE THEREBETWEEN

(75) Inventor: Edward J. Caprario, Elizabeth, NJ (US)

(73) Assignee: CTC International Inc., West Caldwell, NJ (US)

( * ) Notice: Subject to any disclaimer, the term of this patent is extended or adjusted under 35 U.S.C. 154(b) by 0 days.

(21) Appl. No.: 09/325,180

(22) Filed: Jun. 3, 1999

(51) Int. Cl.[7] ..... B65H 18/08
(52) U.S. Cl. ..... 242/531.1; 242/527.2
(58) Field of Search ..... 242/531, 531.1, 242/527.2

(56) References Cited

U.S. PATENT DOCUMENTS

| | | | | |
|---|---|---|---|---|
| 4,489,900 | * | 12/1984 | Morizzo | 242/531.1 |
| 5,086,986 | | 2/1992 | Twente . | |
| 5,240,196 | | 8/1993 | Baarfuesser . | |
| 5,383,622 | | 1/1995 | Kohler . | |
| 5,810,280 | | 9/1998 | Ryan et al. . | |
| 6,062,507 | * | 5/2000 | Summey, III | 242/541 |

FOREIGN PATENT DOCUMENTS

| | | |
|---|---|---|
| 3033765 | 10/1981 | (DE) . |
| 0382898 | 8/1990 | (EP) . |
| 56-113644 | 9/1981 | (JP) . |

* cited by examiner

*Primary Examiner*—John Q. Nguyen
(74) *Attorney, Agent, or Firm*—Richard M. Goldberg

(57) ABSTRACT

A web winding apparatus includes a frame support having a horizontal track arrangement; a first mandrel rotatably mounted at a first fixed position on the frame support above the track arrangement, for removably holding a core thereon; a second mandrel rotatably mounted at a second fixed position on the frame support above the track arrangement, for removably holding a core thereon; a motor drive for rotating the first and second mandrels; a carriage movable between first and second carriage positions along the track arrangement below the first and second fixed positions, respectively, for guiding a web onto the core on the first mandrel at the first carriage position and cutting the web thereat, and for guiding a web onto the core on the second mandrel at the second carriage position and cutting the web thereat, the carriage including a first support, first guide rollers mounted to the first support for riding along the linear track arrangement, second guide rollers mounted to the first support, a second support for riding between said second rollers in a vertical direction, and pressure rollers, web guide rollers and knives mounted to the second support for movement therewith; a drive mechanism associated with each of the first and second carriage positions for moving the second support toward the respective first and second mandrels; and a drive arrangement secured to the first support for moving the carriage between the first and second carriage positions.

17 Claims, 3 Drawing Sheets

FIG. 1
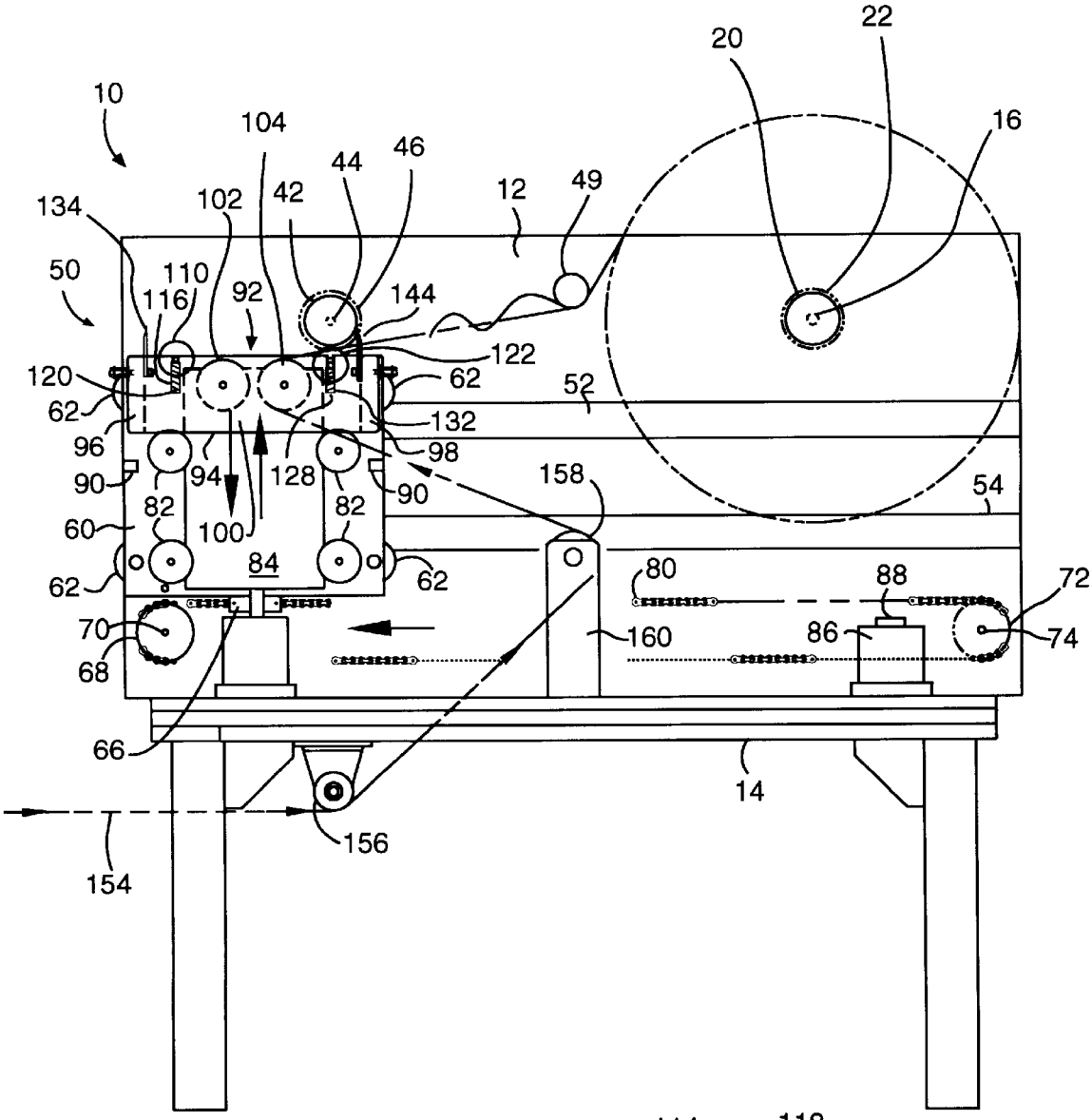
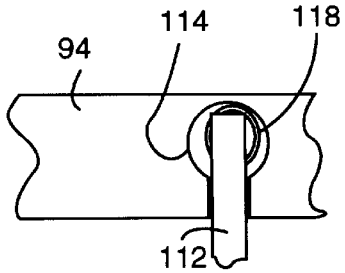
*Fig. 4*

WEB WINDING APPARATUS WITH TWO MANDRELS MOUNTED AT FIXED POSITIONS AND KNIFE CARRIAGE MOVABLE THEREBETWEEN

BACKGROUND OF THE INVENTION

The present invention relates generally to web winding apparatus, and more particularly, is directed to web winding apparatus for alternately winding a web onto cores mounted on two mandrels at fixed positions.

In many instances, a silicone layer has a paper or plastic top layer adhesively mounted thereon. The top layer is printed with labels, and the top layer is die cut around the labels. Then, the silicone layer with labels thereon is wound on a core. During a labeling operation, the labels are removed and applied, for example, to containers. The remaining top layer therefore has a plurality of openings therein, and is called a skeleton or matrix, the latter term being used herein.

The matrix is wound onto a disposal or rewind core mounted on a mandrel. When the rewind roll (core plus matrix) acquires a predetermined diameter of matrix thereon, it must be removed, and a new rewind core mounted on the mandrel. However, this requires shutting down the machine, resulting in downtime. This becomes cumbersome in practice, and costly.

In U.S. Pat. No. 5,810,280 to Ryan et al and having a common assignee herewith, there is disclosed a matrix rewinder, in which a matrix or skeleton of a used web is wound onto a core on a mandrel for removal. In order to provide that the machine is not stopped, three mandrels are provided offset from each other by 120°, and are sequentially brought into position for rewinding the matrix. However, the device of this patent does not always work properly with some types of webs, since the webs do not break, but must be cut.

OBJECTS AND SUMMARY OF THE INVENTION

Accordingly, it is an object of the present invention to provide a web winding apparatus that overcomes the problems with the aforementioned prior art.

It is another object of the present invention to provide a web winding apparatus that can be used with all types of webs.

It is still another object of the present invention to provide a web winding apparatus that does not require stopping the machine in order to change a fully wound core on a mandrel.

It is yet another object of the present invention to provide a web winding apparatus in which there are a plurality of mandrels at fixed positions, and a carriage that moves between the mandrels.

It is a further object of the present invention to provide a web winding apparatus that is greatly simplified in construction.

In accordance with an aspect of the present invention, a web winding apparatus includes a frame support; a first mandrel rotatably mounted at a first fixed position on the frame support, for removably holding a core thereon; a second mandrel rotatably mounted at a second fixed position on the frame support which is different from the first position, for removably holding a core thereon; a motor drive for rotating the first mandrel and the second mandrel; and a carriage movable between first and second carriage positions in close proximity to the first and second fixed positions, respectively, for guiding a web onto the core on the first mandrel at the first carriage position and cutting the web thereat, and for guiding a web onto the core on the second mandrel at the second carriage position and cutting the web thereat.

The carriage is movable in a linear manner between the first carriage position and the second carriage position. In this regard, a linear track arrangement is provided on the frame support, and the carriage includes a plurality of guide rollers for riding along the linear track arrangement between the first and second carriage positions such that the first carriage position is below the first mandrel, and the second carriage position is below the second mandrel.

The carriage is normally spaced from the cores on the first and second mandrels at the first and second carriage positions, respectively, and the carriage is further movable in a direction toward and away from the first and second mandrels at the first and second carriage positions. In this regard, the carriage includes at least one pressure roller for engaging the core on the first and second mandrels at the first and second carriage positions, respectively, when the carriage is moved in the direction toward the first and second mandrels at the first and second carriage positions, respectively.

Thus, the carriage includes a first support and a second support, and the at least one pressure roller is mounted on the second support. The apparatus further includes a first linear track arrangement on the frame support or the first support, a plurality of first guide rollers mounted to the other of the frame support and the first support, for engagement with the first linear track arrangement, such that the first support moves in a first direction along the first linear track arrangement between the first and second carriage positions, a plurality of second guide rollers mounted to the first support or the second support, and a second linear track arrangement provided on the other of the first support and the second support and along which the plurality of second guide rollers ride, such that the second support moves in a second direction substantially perpendicular to the first direction, toward and away from the first and second mandrels at the first and second carriage positions, with the at least one pressure roller mounted for movement with the second support.

Preferably, the first linear track arrangement is mounted on the frame support; the plurality of first guide rollers are mounted to the first support for riding in the first direction along the first linear track arrangement between the first and second carriage positions; the plurality of second guide rollers are mounted to the first support; and the second support is positioned between and guided by the plurality of second guide rollers, with side edges of the second support forming the second linear track arrangement, for movement of the second support in the second direction substantially perpendicular to the first direction, toward and away from the first and second mandrels at the first and second carriage positions.

The carriage further includes at least one web guide roller mounted for movement with the second support, for guiding a web to the core on the first or second mandrel, and at least one knife mounted for movement with the second support, such that the at least one knife cuts the web when the at least one pressure roller is moved into engagement with the core on the first or second mandrel.

The carriage further includes a frame assembly fixedly mounted to the second support and extending outwardly therefrom, with the at least one pressure roller, the at least one further guide roller and the at least one knife mounted to the frame assembly.

In this regard, each knife is secured to a side wall of the frame assembly by a spring biased assembly that permits the knife to deflect slightly.

Also, each pressure roller includes a roller shaft mounted in grooves in front and rear walls of the frame assembly, and the carriage further includes springs mounted between the front and rear walls and the roller shaft to bias the roller shaft in a direction toward the respective first or second mandrel.

A drive mechanism is associated with each of the first and second carriage positions for moving the second support toward the respective first and second mandrels. The drive mechanism includes a cylinder having a piston rod movable by the cylinder such that engagement of the piston rod with the second support moves the second support toward the respective first and second mandrels.

A drive arrangement is also secured to the first support for moving the carriage between the first and second carriage positions. The drive arrangement includes first and second pulleys rotatably mounted to the frame adjacent the first and second carriage positions; an endless chain wrapped about the first and second pulleys, and the endless chain connected to the first support; and a motor having a motor shaft drivingly connected with one of the pulleys for rotating the one pulley.

The above and other objects, features and advantages of the invention will become readily apparent from the following detailed description thereof which is to be read in connection with the accompanying drawings.

BRIEF DESCRIPTION OF THE DRAWINGS

FIG. 1 is a front elevational view of a portion of a web winding apparatus according to the present invention;

FIG. 4 is a top plan view of a portion of the carriage of FIG. 3, viewed from line 4—4 thereof, with the retainer plate removed.

DETAILED DESCRIPTION

Figure 2:
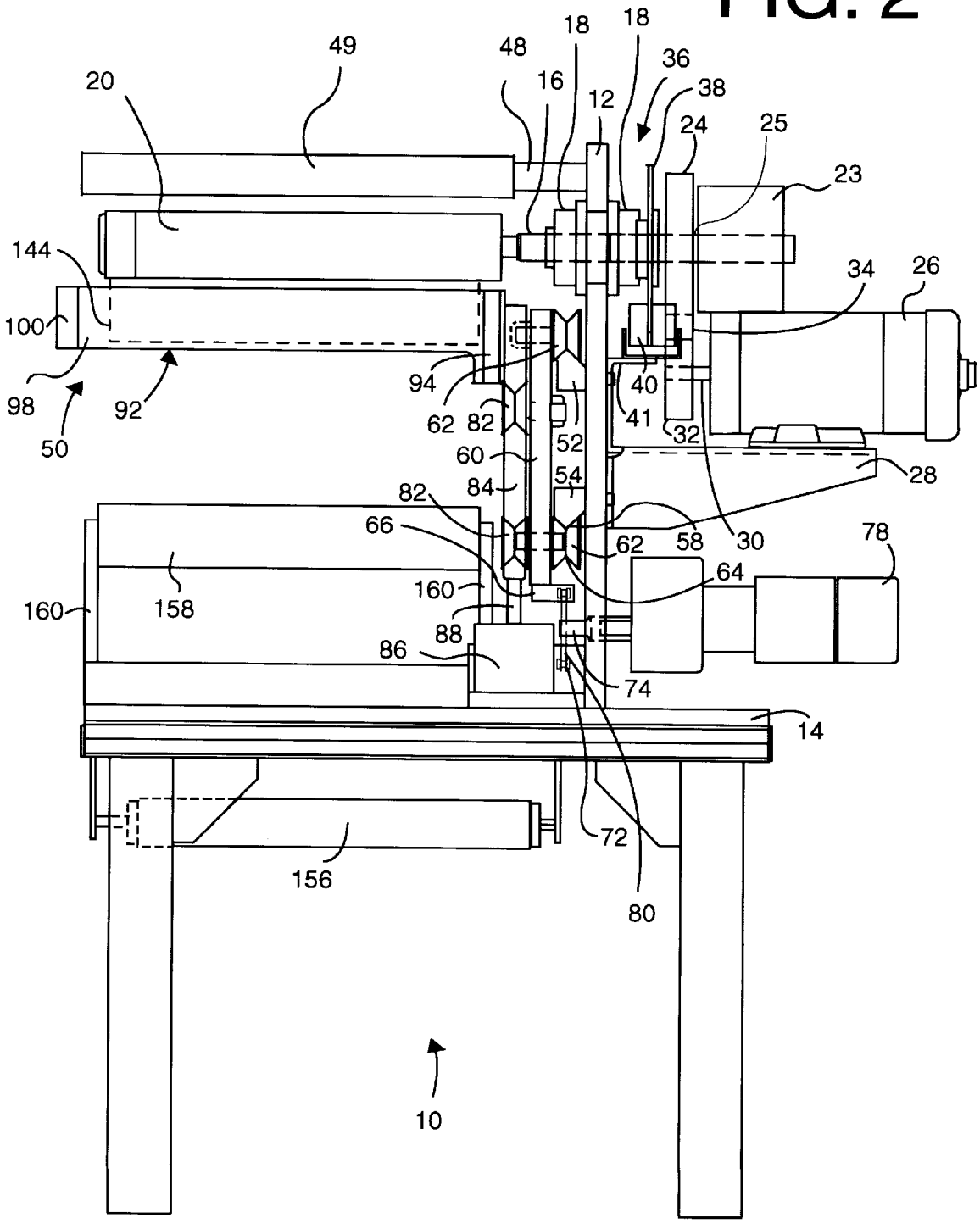
FIG. 2 is an end elevational view of the web winding apparatus of FIG. 1.

Referring to the drawings in detail, a web winding apparatus 10 according to the present invention includes a vertically oriented, planar frame plate 12 mounted on a support 14, which in the present instance, is shown as a horizontally oriented top of a support table, although the present invention is not limited thereto. A first shaft 16 extends through an opening (not shown) in plate 12 and is rotatably mounted therein by bearing assemblies 18. The portion of shaft 16 that extends to the front of plate 12 has a first mandrel 20, preferably with an air chuck fixed thereon, and mandrel 20 is rotatable with shaft 16. Mandrel 20, as is conventional, is adapted to hold a core 22 (FIG. 1) around which a web of material can be wrapped, while also permitting easy replacement of core 22. Thus, mandrel 20 is stationary, that is, fixed in position relative to frame plate 12, but can rotate about its own axis.

The rear portion of shaft 16 has an adjustable slip clutch 23 thereon, which is connected with a pulley 24 through a shaft 25. A motor 26 is mounted on a support shelf 28 secured to the rear of frame plate 12, and has an output shaft 30 with a pulley 32 mounted thereon. An endless belt 34 extends between pulleys 24 and 32 for driving clutch 23 which in turn rotates shaft 16, and thereby mandrel 20. Further, to stop rotation of shaft 16, a disc brake system 36 is also provided, and includes a disc 38 fixed on shaft 16 and a braking arrangement 40 which can be a magnetic brake, calipers, or any other suitable arrangement, mounted on a support bracket 41 fixed to the rear of plate 12. Accordingly, accurate driving of mandrel 20 can be achieved, so as to obtain accurate tension on the web wound on a core 22.

A second mandrel 42 is mounted on a second shaft 44 that is rotatably mounted in bearing assemblies and extends through plate 12. The mounting and drive assembly for second shaft 44 is identical to that of first shaft 16. Mandrel 42 is of the same construction as mandrel 20 and is adapted to hold a core 46 (FIG. 1) around which a web of material can be wrapped, while also permitting easy replacement of core 46 thereon. Mandrel 42, like mandrel 20, is stationary, that is, fixed in position relative to frame plate 12, but can rotate about its own axis.

Second mandrel 42 is offset laterally from first mandrel 20, but is at the same height so that both mandrels 20 and 42, and cores 22 and 46, can be accessed by a movable carriage to be described hereinafter.

In addition, a shaft 48 extends from the front of plate 12 at a position midway between shafts 16 and 44, but at a slightly greater height thereon, and includes a roller 49 rotatably mounted thereon, the purpose for which will be understood from the description hereinafter.

A carriage 50 is movable from a first carriage position beneath first mandrel 20 to a second carriage position beneath second mandrel 42, and back again to the first carriage position.

In this regard, upper and lower tracks 52 and 54 are secured in parallel, spaced apart relation at the front surface of frame plate 12, so as to extend horizontally below mandrels 20 and 42. Upper track 52 includes an inverted V-shaped upper surface 56, while lower track 54 includes a V-shaped lower surface 58, as shown in FIG. 2.

Carriage 50 includes a vertically oriented, substantially square-shaped rear support plate 60 having four rollers 62 rotatably mounted to the rear surface at the four corners thereof. Each roller 62 has a V-shaped circumferential groove 64 therein for riding on either inverted V-shaped upper surface 56 or V-shaped lower surface 58. Thus, rollers 62 are positioned so that there are two upper rollers 62 that ride on inverted V-shaped upper surface 56 of upper track 52 and two lower rollers 62 that ride on V-shaped lower surface 58 of lower track 54, whereby rear support plate 60 is restrained to only move horizontally, that is, left and right in FIG. 1. Of course, the opposite arrangement could be provided, that is, rollers 62 mounted to frame plate 12 and linear tracks 52 and 54 provided on rear support plate 60, although this arrangement would not be as desirable in view of the large number of rollers 62 that would be required.

In order to move rear support plate 60 horizontally, there is provided a lower projection 66 secured to the lower edge of rear support plate 60. A first pulley 68 is mounted on a shaft 70 that is rotatably mounted to a first lower corner of frame plate 12, and a second pulley 72 is mounted on a motor shaft 74 of a motor 78, with shaft 74 extending through an opening (not shown) in frame plate 12 at the opposite lower corner. An endless chain 80 rides over pulleys 68 and 72 and is fixed to lower projection 66. Thus, as motor 78 rotates motor shaft 74, and thereby pulley 72, endless chain 80 is caused to move, thereby moving rear support plate 60 of carriage 50 to the left or right in FIG. 1.

Carriage 50 also has a component that can move vertically. Specifically, two pair of vertically aligned and horizontally spaced rollers 82 are rotatably mounted to the front surface of frame plate 12. A center support plate 84 is held between rollers 82 so as to be vertically guided at opposite side edges thereof by rollers 82, and thereby be vertically movable. In this regard, opposite side edges of center support plate 84 constitute linear tracks which ride along rollers 82. of course, the opposite arrangement could be provided, that is, rollers 82 could be mounted to center support plate 84 and ride along linear tracks fixed to rear support plate 60. A pneumatic or hydraulic cylinder 86 is mounted on the upper surface of the table top of support 14 below and slightly outwardly of each mandrel 20 and 42, and includes a vertically movable piston rod 88, the upper end of which is adapted to engage the lower edge of center support plate 84 in order to push center support plate 84 upwardly between rollers 82. When a piston rod 88 is retracted or lowered, center support plate 84 falls vertically down by gravity. Stops 90 are secured to the front surface of rear support plate 60, to limit the extent that center support plate 84 can travel downwardly when a piston rod 88 is retracted or lowered, as will be understood from the description hereinafter.

Figure 3:
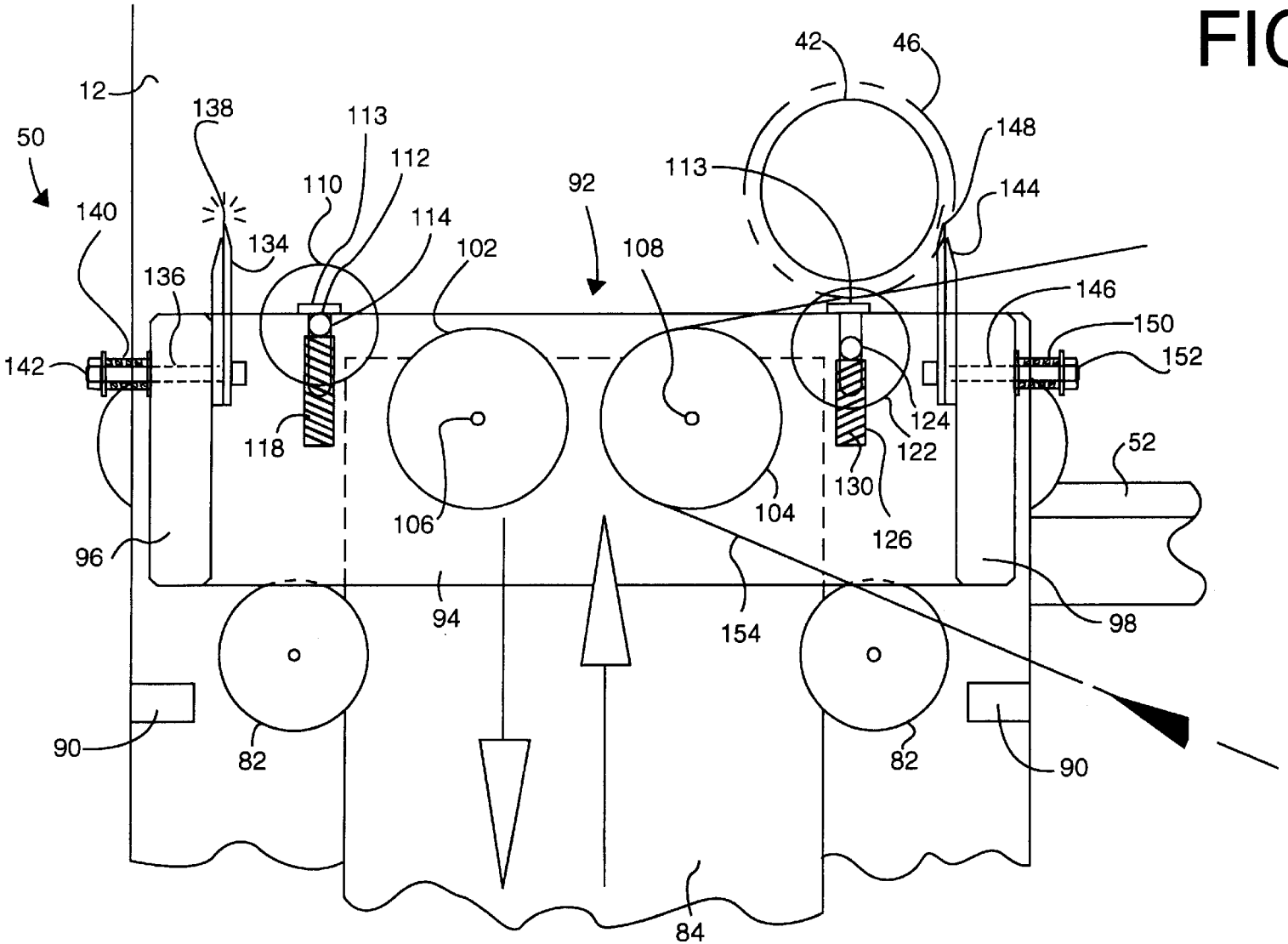
FIG. 3 is an enlarged front elevational view of the carriage assembly of the web winding apparatus of FIG. 1.

A frame assembly 92 is mounted to center support plate 84 and travels therewith. Frame assembly 92 includes a rear frame plate 94 fixedly secured to an upper end of center support plate 84. Rear frame plate 94 preferably has a width similar to the width of rear support plate 60 and a height much less than that of center support plate 84. Preferably, the upper edge of rear frame plate 94 is substantially coincident with the upper edge of rear support plate 60 when the respective piston rod 88 is at its uppermost position. The lower edge of rear frame plate 94 abuts against stops 90 during the downward travel of center support plate 84 so as to limit the downward travel thereof. Frame assembly 92 also includes two side frame plates 96 and 98 of similar height to rear frame plate 94 and secured at opposite edges thereof so as to extend forwardly, and a front frame plate 100 secured to the front edges of side frame plates 96 and 98. Front frame plate 100 has been removed from FIG. 3 to better show the remaining structure. Accordingly, frame plates 94, 96, 98 and 100 form frame assembly 92 into a rectangular frame structure.

Two rollers 102 and 104 are rotatably mounted on shafts 106 and 108, respectively, that extend between rear frame plate 94 and front frame plate 100, at a center portion of frame assembly 92 and with a gap between rollers 102 and 104.

A first pressure roller 110 is rotatably mounted on a shaft 112 that extends parallel to roller 102 and which is positioned slightly outwardly and upwardly therefrom. One end of shaft 112 is mounted in a vertical groove 114 in rear frame plate 94, while the opposite end of shaft 112 is mounted in a vertical groove 116 in front frame plate 100. A coil spring 118 is mounted in a wider portion of groove 114 while a coil spring 120 is mounted in a wider portion of groove 116, so as to normally bias shaft 112 to an upward position as shown. A retainer plate 113 is positioned over vertical grooves 114 and 116 to prevent the shafts from exiting grooves 114 and 116.

A second pressure roller 122 is rotatably mounted on a shaft 124 that extends parallel to roller 104 and which is positioned slightly outwardly and upwardly therefrom. One end of shaft 124 is mounted in a vertical groove 126 in rear frame plate 94, while the opposite end of shaft 124 is mounted in a vertical groove 128 in front frame plate 100. A coil spring 130 is mounted in a wider portion of groove 126 while a coil spring 132 is mounted in a wider portion of groove 128, so as to normally bias shaft 124 to an upward position, with coil springs 130 and 132 being adapted to be compressed to the positions shown in FIGS. 1 and 3. A similar retainer plate 113 is positioned over vertical grooves 126 and 128 to prevent the shafts from exiting grooves 126 and 128.

In addition, a first knife 134 is mounted to side frame plate 96 and extends substantially the entire length thereof. First knife 134 is vertically mounted to the inner surface of side frame plate 96 by a plurality of bolts 136 extending through side frame plate 96, such that first knife 134 extends to a height above side frame plate 96, with the sharp edge 138 of first knife 134 exposed at the upper free edge thereof. Coil springs 140 are wrapped about bolts 136 and extend between the bolt heads 142 and the outer surface of side frame plate 96. This results in knife 134 serving to force the web onto the core so as to adhere the web thereto. In addition, if an excessive force is applied to first knife 134, first knife 134 will deflect due to coil spring 140 to prevent breakage of the knife.

A second knife 144 is mounted to side frame plate 98 and extends substantially the entire length thereof. Second knife 136 is vertically mounted to the inner surface of side frame plate 98 by a plurality of bolts 146 extending through side frame plate 98, such that second knife 144 extends to a height above side frame plate 98, with the sharp edge 148 of second knife 144 exposed at the upper free edge thereof. Coil springs 150 are wrapped about bolts 146 and extend between the bolt heads 152 and the outer surface of side frame plate 98. This results in knife 144 serving to force the web onto the core so as to adhere the web thereto. In addition, if an excessive force is applied to second knife 144, second knife 144 will deflect due to coil spring 150 to prevent breakage of the knife.

FIG. 1 shows a web 154 coming from a larger machine, with web 154 extending around a lower stationary roller 156 secured to the underside of support 14, and then to a stationary roller 158 rotatably mounted on posts 160 at the upper surface of support 14 at a mid-point between mandrels 20 and 42. Web 154 can be a matrix or skeleton, as discussed above, but is not limited thereto. From roller 158, web 154 travels through carriage 50, and in particular, about roller 104, is then engaged at the underside of roller 49 and is wrapped about core 22 on first mandrel 20. The core 22 on first mandrel 20 can have tape thereon for engagement with the start of web 154, or alternatively, web 154 can have an adhesive surface that automatically adheres onto core 22, as with a matrix or skeleton of a web. At this time, first mandrel 20 is rotated to wind web 154 thereon.

In the condition, with web 154 being wound on core 22, center support plate 84 is at a lowered position and in the second carriage position at the left of FIG. 1 to a position beneath mandrel 42. Further, in this condition, a new core 46 is positioned on mandrel 42 and held thereon.

When the roll (core 22 plus web 154 wound thereon) reaches a predetermined diameter, as detected by a sensor (not shown), as is conventional, center support plate 84 is moved upwardly by piston rod 88 at the second carriage position. As a result, pressure roller 122 moves web 154 into adhesive engagement with core 46. This results in pressure roller 122 being pushed down against the force of coil springs 130 and 132 in order to ensure that there is a pressing force against core 46. At the same time, mandrel 42 is caused to rotate, and knife 144 simultaneously is moved upward to cut web 154 extending to core 22 and press web 154 onto core 46. As a result, the new free end of web 154 begins winding about core 46. This can be the result of adhesive on core 46 or adhesive on web 154 itself.

Thereafter, center support plate 84 is lowered, whereby roller 122 disengages from web 154 and knife 144 is also lowered. This occurs by gravity when the respective piston rod 88 is retracted or lowered. The lowermost position is achieved when rear frame plate 94 abuts against stops 90.

Then, the roll (core 22 with the web 154 thereon) on first mandrel 20, is removed from mandrel 20 and a new core 22 is placed thereon. Thereafter, carriage 50 is moved to the right of FIG. 1 by endless chain 80, to a position below mandrel 20 and the new core 22. At this time, there is a shift of web 154 from roller 104 to roller 102.

This operation continues by the horizontal and vertical movements of carriage 50 each time that web 154 reaches a predetermined diameter on core 22 or 46.

Because of the use of knives 134 and 144, web winding apparatus 10 can be used with all types of webs, and also, because of the use of carriage 50, does not require stopping the machine in order to change a full core. In addition, because mandrels 20 and 42 are not moved, the apparatus becomes much simpler, since movement of a full core 22 and 46 requires relatively bulky, heavy and complicated machinery. Rather, the present invention provides an arrangement in which there are a plurality of stationary mandrels 20 and 42, and a carriage 50 that moves between mandrels 20 and 42.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A web winding apparatus comprising:

a frame support having a horizontally oriented linear track arrangement;

a first mandrel rotatably mounted at a first fixed position on the frame support above the track arrangement, for removably holding a core thereon;

a second mandrel rotatably mounted at a second fixed position on the frame support which is different from the first position and above the track arrangement, for removably holding a core thereon;

a motor drive for rotating the first mandrel and the second mandrel;

a carriage movable between first and second carriage positions on the track arrangement below and in close proximity to the first and second fixed positions, respectively, for guiding a web onto the core on the first mandrel at the first carriage position and cutting the web thereat, and for guiding a web onto the core on the second mandrel at the second carriage position and cutting the web thereat, the carriage including:

a first support, first guide rollers mounted to the first support for riding on the linear track arrangement, second guide rollers mounted to the first support, a second support for riding between said second rollers in a vertical direction, a frame assembly mounted to the second support, at least one pressure roller mounted to the frame assembly, at least one web guide roller mounted to the frame assembly, and at least one knife mounted to said frame assembly;

a drive mechanism associated with each of said first and second carriage positions for moving said second support toward the respective first and second mandrels; and a drive arrangement secured to the first support for moving the carriage between the first and second carriage positions.

2. A web winding apparatus comprising:

a frame support;

a first mandrel rotatably mounted at a first fixed position on said frame support, for removably holding a core thereon;

a second mandrel rotatably mounted at a second fixed position on said frame support which is different from said first position, for removably holding a core thereon;

a motor drive for rotating said first mandrel and said second mandrel; and a carriage movable between first and second carriage positions in close proximity to said first and second fixed positions, respectively, for guiding a web onto the core on said first mandrel at said first carriage position and cutting said web thereat, and for guiding a web onto the core on said second mandrel at said second carriage position and cutting said web thereat, said carriage including:

a first support moveable substantially only in a first linear direction between said first and second carriage positions, and a second support positioned on said first support and moveable relative to said first support substantially only in a second linear direction substantially perpendicular to said first linear direction, toward and away from said first and second mandrels at said first and second carriage positions, respectively.

3. A web winding apparatus according to claim 2, further comprising a linear track arrangement on said frame support, and said carriage includes a plurality of guide rollers for riding on said linear track arrangement between said first and second carriage positions.

4. A web winding apparatus according to claim 2, wherein said first carriage position is below said first mandrel, and said second carriage position is below said second mandrel.

5. A web winding apparatus according to claim 2, wherein said carriage is normally spaced from the cores on said first and second mandrels at said first and second carriage positions, respectively, and said carriage is further movable in a direction toward and away from said first and second mandrels at said first and second carriage positions.

6. A web winding apparatus according to claim 5, wherein said carriage includes at least one pressure roller for engaging the core on said first and second mandrels at said first and second carriage positions, respectively, when said carriage is moved in said direction toward said first and second mandrels at said first and second carriage positions, respectively.

7. A web winding apparatus comprising:

a frame support;

a first mandrel rotatably mounted at a first fixed position on said frame support, for removably holding a core thereon;

a second mandrel rotatable mounted at a second fixed position on said frame support which is different from said first position, for removably holding a core thereon;

a motor drive for rotating said first mandrel and said second mandrel; and a carriage movable between first and second carriage positions in close proximity to said first and second fixed positions, respectively, for guiding a web onto the core on said first mandrel at said first carriage position and cutting said web thereat, and for guiding a web onto the core on said second mandrel at said second carriage position and cutting said web thereat, said carriage normally being spaced from the cores on said first and second mandrels at said first and second carriage positions, respectively, and said carriage being further movable in a direction toward and away from said first and second mandrels at said first and second carriage positions, said carriage including at least one pressure roller for engaging the core on said first and second mandrels at said first and second carriage positions, respectively, when said carriage is moved in said direction toward said first and second mandrels at said first and second carriage positions, respectively, and said carriage including a first support and a second support, and said at least one pressure roller is mounted on said second support;

a first linear track arrangement on one of said frame support and said first support;

a plurality of first guide rollers mounted to the other of said frame support and said first support, for engagement with said first linear track arrangement, such that said first support moves in a first direction on said first linear track arrangement between said first and second carriage positions;

a plurality of second guide rollers mounted to one of said first support and said second support; and a second linear track arrangement provided on the other of said first support and said second support and on which said plurality of second guide rollers ride, such that said second support moves in a second direction substantially perpendicular to said first direction, toward and away from said first and second mandrels at said first and second carriage positions, respectively, with said at least one pressure roller mounted for movement with said second support.

8. A web winding apparatus according to claim 7, wherein said first linear track arrangement is mounted on said frame support;

said plurality of first guide rollers are mounted to said first support for riding in said first direction on said first linear track arrangement between said first and second carriage positions;

said plurality of second guide rollers are mounted to said first support; and said second support is positioned between and guided by said plurality of second guide rollers, with side edges of said second support forming said second linear track arrangement, for movement of said second support in said second direction substantially perpendicular to said first direction, toward and away from said first and second mandrels at said first and second carriage positions respectively.

9. A web winding apparatus according to claim 7, wherein said carriage further comprises at least one web guide roller mounted for movement with said second support, for guiding a web to the core on the first or second mandrel.

10. A web winding apparatus according to claim 9, wherein said carriage further comprises at least one knife mounted for movement with said second support, such that said at least one knife cuts the web when said at least one pressure roller is moved into engagement with the core on said first or second mandrel.

11. A web winding apparatus according to claim 10, wherein said carriage further includes a frame assembly fixedly mounted to said second support and extending outwardly therefrom, with said at least one pressure roller, said at least one web guide roller and said at least one knife mounted to said frame assembly.

12. A web winding apparatus according to claim 11, wherein each said knife is secured to a side wall of said frame assembly by a spring biased assembly that permits said knife to deflect slightly.

13. A web winding apparatus according to claim 11, wherein each said pressure roller includes a roller shaft mounted in grooves in front and rear walls of said frame assembly, and said carriage further includes springs mounted between said front and rear walls and said roller shaft to bias said roller shaft in a direction toward the respective first or second mandrel.

14. A web winding apparatus according to claim 7, further comprising a drive mechanism associated with each of said first and second carriage positions for moving said second support toward the respective first and second mandrels.

15. A web winding apparatus according to claim 14, wherein each said drive mechanism includes a cylinder having a piston rod movable by said cylinder such that engagement of said piston rod with said second support moves said second support toward the respective first and second mandrels.

16. A web winding apparatus according to claim 7, further comprising a drive arrangement secured to said first support for moving said carriage between said first and second carriage positions.

17. A web winding apparatus according to claim 16, wherein said drive arrangement includes:

first and second pulleys rotatably mounted to said frame adjacent said first and second carriage positions;

an endless chain wrapped about said first and second pulleys, and said endless chain connected to said first support; and a motor having a motor shaft drivingly connected with one of said pulleys for rotating said one pulley.

* * * * *